US005687861A

United States Patent [19]

Wiedemann

[11] Patent Number: 5,687,861

[45] Date of Patent: Nov. 18, 1997

[54] SQUEEZEABLE BABY BOTTLE

[76] Inventor: Warren Wiedemann, 62 Spring Valley Rd., Paramus, N.J. 07652

[21] Appl. No.: 616,620

[22] Filed: Mar. 25, 1996

[51] Int. Cl.[6] ..... A61J 9/00; A61J 9/08; B65D 23/02

[52] U.S. Cl. ..... 215/11.3; 215/11.1; 215/11.6; 215/900

[58] Field of Search ..... 215/11.3, 11.6, 215/383, 11.1

[56] References Cited

U.S. PATENT DOCUMENTS

| | | | |
|---|---|---|---|
| 3,134,494 | 5/1964 | Quinn | 215/11.3 |
| 3,143,429 | 8/1964 | Swanson et al. | 215/383 X |
| 4,558,792 | 12/1985 | Cabernoch et al. | 215/11.3 |
| 4,813,556 | 3/1989 | Lawrence | 215/11.3 |
| 4,944,418 | 7/1990 | Wallace | 215/11.3 X |
| 4,979,629 | 12/1990 | Askerneese | 215/11.3 X |
| 5,033,631 | 7/1991 | Nightingale | 215/11.3 X |
| 5,109,996 | 5/1992 | Sullivan | 215/11.3 X |
| 5,356,016 | 10/1994 | Wiedemann | 215/11.3 |

FOREIGN PATENT DOCUMENTS

| | | | |
|---|---|---|---|
| 2109247 | 6/1983 | United Kingdom | 215/11.6 |
| 2208291 | 3/1989 | United Kingdom | 215/11.1 |

*Primary Examiner*—Sue A. Weaver
*Attorney, Agent, or Firm*—Terrance L. Siemens

[57] ABSTRACT

An infant nursing device has flexible side walls which may be compressed to cause pressure on the removable internal fluid containing bag causes air to be expelled out of the unidirectional tip opening of a nipple located atop the device. The infant nursing device is assembled by securing a top assembly to the top portion of the device. The top assembly holds the removable bag and nipple assembly in place. The infant nursing device does not include any mechanical parts that may get caught on the baby, clothes, and surrounding things, while providing an easy method and device for removing air from a baby's nursing food.

5 Claims, 3 Drawing Sheets

SQUEEZEABLE BABY BOTTLE

FIELD OF THE INVENTION

The present invention relates to infant care and feeding. More specifically, it relates to nursing baby bottles with removal lining and means for expelling air from the lining so that only fluid remains within the lining. Ingestion of air with bottle contained liquid nutrient has long been a problem with bottle feeding babies. The ingested air can cause the infant severe gastric distress since infants do not have a self developed diaphragmatic burping reflex. Therefore, a physical expulsion of air, ingested while feeding, may often be necessary by means of the caretaker gently burping the baby. Although the baby bottle was intended to relieve the breast feeding mother of the burden of breast feeding the baby, the baby bottle still allows for the ingestion of air, thereby promoting gastric distress within and requiring burping of the baby. In addition, mothers of new-borns are provided little relief from the continual demands of the newborn. Therefore a need exists to make duties of the new mother less time consuming.

BACKGROUND OF THE INVENTION

1. Description of Related Art

Several potential solutions to air trapped in formula within the lining of a baby bottle have been offered. In accordance with conventional terminology, the term bottle used herein may be taken to mean any receptacle enclosing a liquefied feeding substance. The following known related art has been directed to providing means of expelling the air from a flexible bag contained within a bottle. As will be shown, the related art references do not show the novelty of the present invention.

U.S. Pat. No. 5,356,016 issued to Wiedemann on Oct. 18, 1994 discloses a baby bottle with a removable lining and a longitudinally moveable plunger for the expelling of air from the lining. The Wiedemann bottle differs from the instant invention in that the former relies on the working of a plunger to remove air from an internal lining, while the latter works by the squeezing of the baby nursing bottle walls.

U.S. Pat. No. 5,109,996 issued to Sullivan on May 5, 1995 discloses a baby nursing bottle with an internal lining which collapses by use of a plunger to expel air thereby leaving only fluid. The Sullivan baby nursing bottle differs from the instant invention in that removal of air from the lining requires the squeezing of the baby nursing bottle walls.

U.S. Pat. No. 5,033,631 issued to Nightingale on Jul. 23, 1991 discloses a baby nursing bottle with an internal lining which collapses by the upward compressing motion of a plunger from the bottom of the bottle. The Nightingale bottle differs from the instant invention in that no compressing plunger is required for the expelling of air from an internal lining.

U.S. Pat. No. 4,979,629 issued to Askerneese on Dec. 25, 1990 discloses a baby nursing bottle comprising an expeller for expelling air from the bottle. The expeller further comprises a compression means which enters the bottom portion of the baby nursing bottle and collapses the internal lining. In addition, handles on the walls of bottle are provided for gripping while the bottom portion is pushed upward. The Askerneese baby nursing bottle differs from the instant invention in that no compressing means is needed to expel air.

It will be noted that all the related art devices require an end protruding member (either in the form of a piston rod or a separate stand) in order to operate to expel air from the bottle enclosed bag. This end protruding member makes the use of these devices awkward since the member tends to get caught on the infant's bedclothes. Furthermore, none of the above inventions and patents, taken either singularly or in accommodation, is seen to describe the instant invention as claimed and herein described.

2. Summary of the Invention

Briefly, the invention comprises a baby bottle with an internal fluid holding bag, a one direction nipple and flexible side walls. In operation, the top of the baby bottle is removed and the internal fluid holding bag is filled with fluid. The top is replaced and any air remaining in the holding bag rises to the top of the holding bag. The flexible side walls are then squeezed inward, thereby compressing the internal fluid holding bag. As a result of the compression, air is forced out the opening within the one way nipple located on the top of the baby bottle. The nipple prevents any air from reentering the holding bag, thereby preventing the bag from expanding back to its original fluid filled shape. The flexible walls, not being attached to the bag return to their original shape. By this method air is removed from the internal bag.

Accordingly, it is a principal object of the present invention to provide a new and improved air expelling infant feeding device which overcomes the disadvantages of the prior art in a simple and effective manner.

It is a major object of the present invention to provide a new infant feeding device with an air expelling device which is enclosed in the feeding bottle during use.

It is another object of the present invention to provide a new method for expelling air from the fluid containing portion of the infant feeding device.

It is another object of the present invention to provide an air expelling device which contains no external protrusions likely to catch on external objects about the feeding.

It is another object of the present invention to provide a method for expelling air from an infant feeding device that is simple to operate so as to require as little thought as possible thereby allowing the user to concentrate on the care of the infant.

It is another object of the present invention to provide an air expelling device wherein the outer walls of the device return to their original shape after compression.

It is another object of the present invention to provide a method for expelling air from an infant feeding device that has a minimum number of moving parts so as to deter breakdown.

Finally, it is a general object of the invention to provide improved elements and arrangements thereof in an apparatus for the purposes described which is inexpensive, dependable and fully effective in accomplishing its intended purposes.

These and other objects of the present invention will be readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
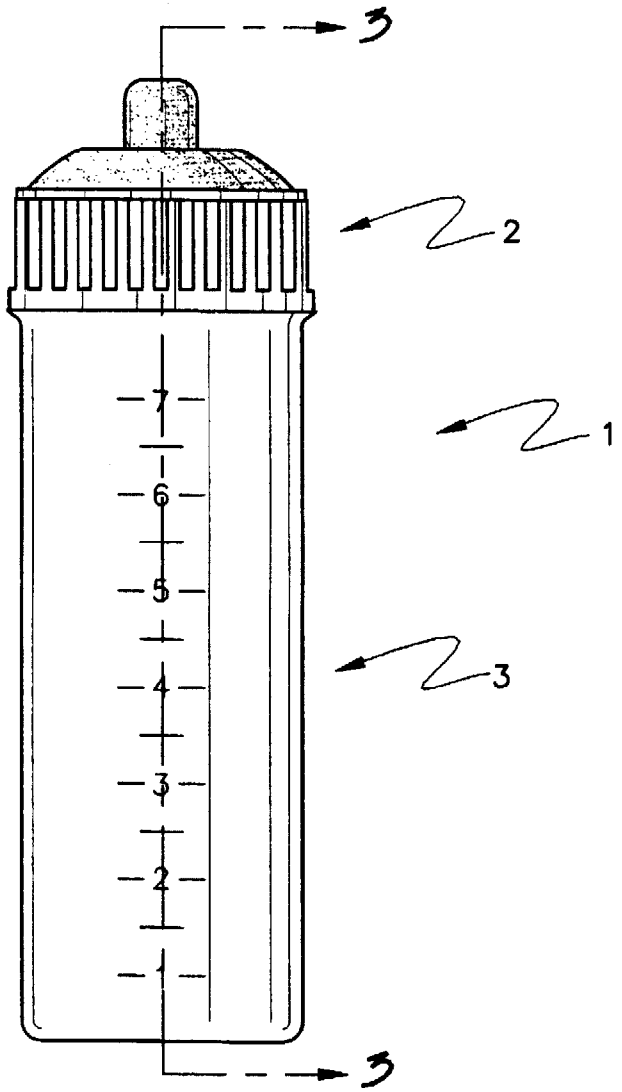
FIG. 1 depicts an assembled embodiment of the invention.

The infant nursing device of the present invention is generally designated by arrow 1 of FIG. 1. The device comprises the following main parts: top cap assembly 2 and central container 3.

Figure 2:
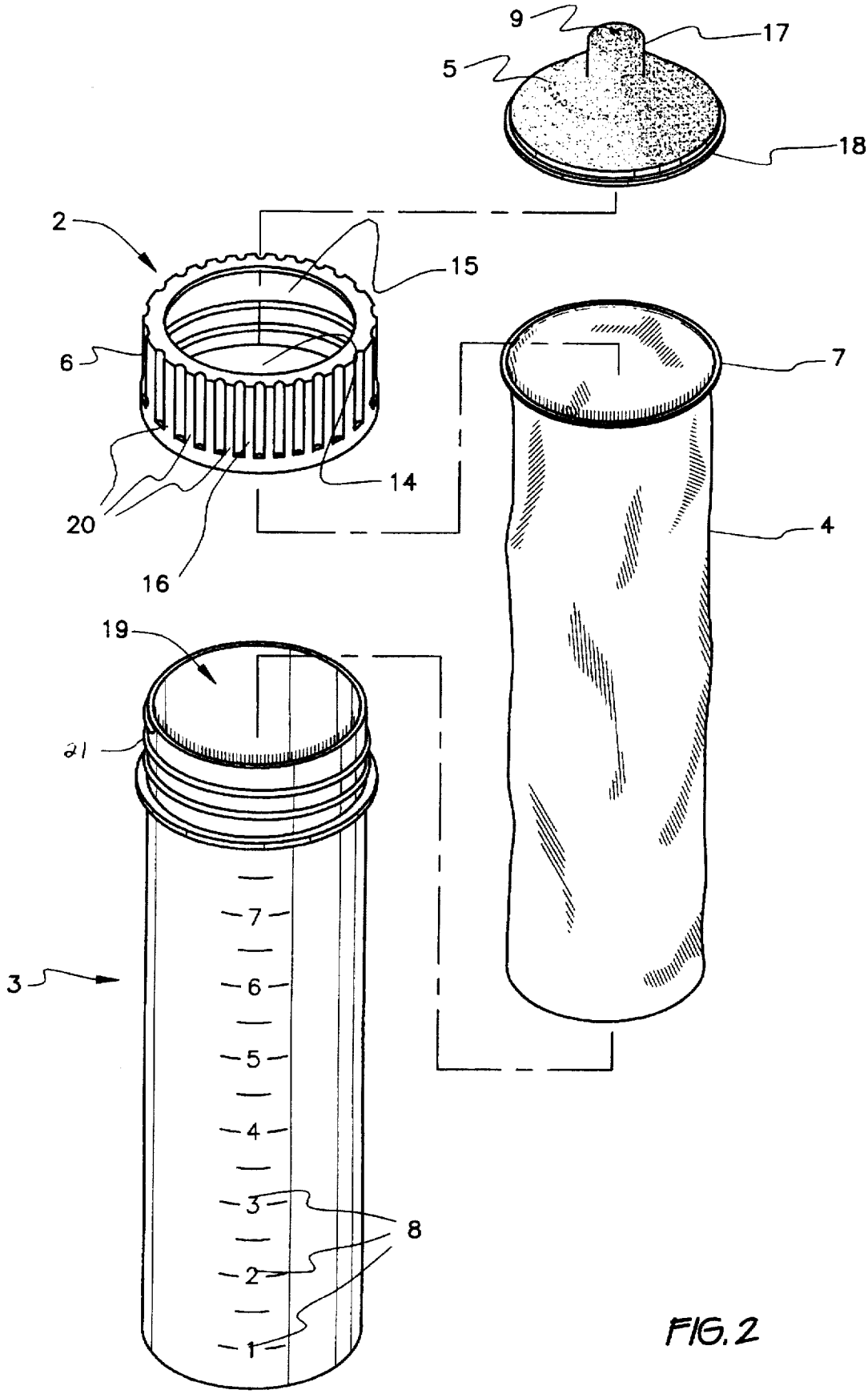
FIG. 2 depicts an exploded elevation view of the embodiment of FIG. 1 showing numerous parts and outer side walls in a non-compressed relaxed position.

As depicted in FIG. 2, the top cap assembly 2 comprises a circular ring with an internal opening 14 defined by an internal perimeter 15. The top cap assembly is further defined by an outer perimeter 16. The outer perimeter 16 extends in a right angle 6 towards the bottom of the infant nursing device and parallel with the outer perimeter of the infant nursing device. Extension 6 further includes ridges 20 used to facilitate manual griping. Ridges 20 may incorporate any design appropriate to facilitate gripping as known to one skilled in the art.

The top assembly 2 further includes a nipple 5 with a conical head 17 and opening 9. Opening 9 facilitates one way outward direction of movement for any contents forced therethrough. Nipple 5 further includes a round bottom 18 of diameter proximate to the diameter of the cap assembly 2 center to outer perimeter 16. The underside of the round bottom includes a central opening to allow contents of the infant nursing device to be forced therein and out through opening 9. Conical head 17 fits within opening 15 and nipple 5 is thereby secured by the fastening of top assembly 2 to the screw top portion 21 of central container 3.

Secured between nipple 5 and screw top portion 21 is lip portion 7 of internal flexible bag 4. Internal flexible bag 4 fits within the central cavity 19 of central container 3. Central container further includes numerals 8 on the outer wall 24 depicted in the natural unflexed state, to designating content level. Outer wall 24 extends downwardly from screw top portion 21 of central container 3, and circumferentially surrounds flexible bag 4. The numerals may be of any configuration as would be contemplated by one skilled in the art. Contained within the clear walls of the central container is the clear internal flexible bag 4. In use, formula or other fluid is placed within the internal flexible bag 4 and may be viewed from without the infant nursing device. The numerals correspond to a given level of fluid held by the internal flexible bag.

Figure 3:
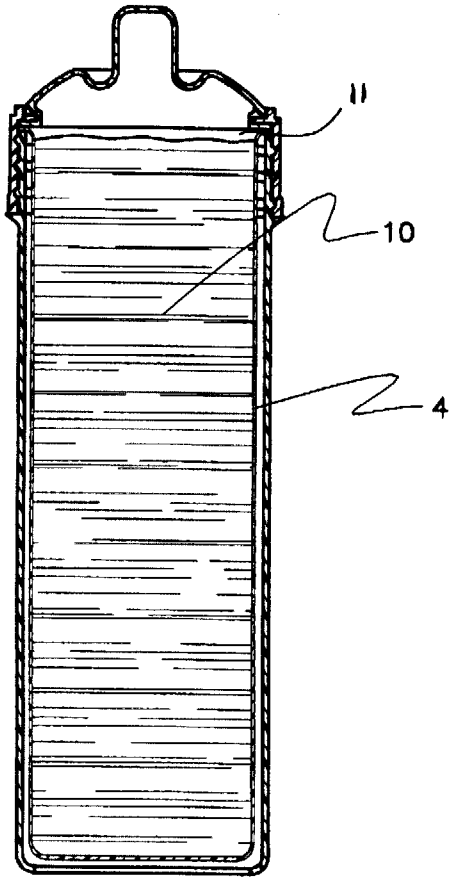
FIG. 3 depicts a cross-section view along line 3—3 of FIG. 1.

As clearly shown in FIG. 3, the bottom edge of outer wall 24 is turned inwardly to form a lip 12 to provide partial support for bag 4 near the outer periphery. It should be noted that an opening 13 is left in the outer container so as to expose the bottom of bag 4. This opening allows the user to manually manipulate bag 4 when desired.

Figure 5:
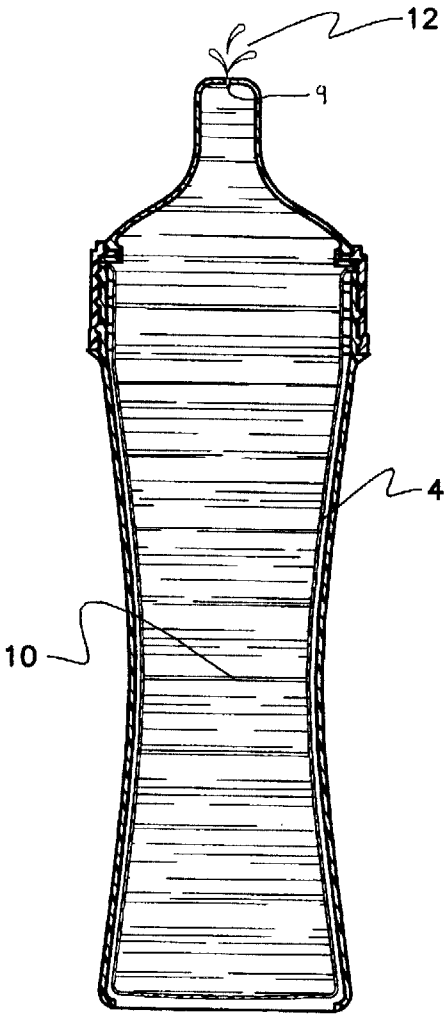
FIG. 5 depicts a cross section of the embodiment of FIG. 4 along line 5—5.
Figure 4:
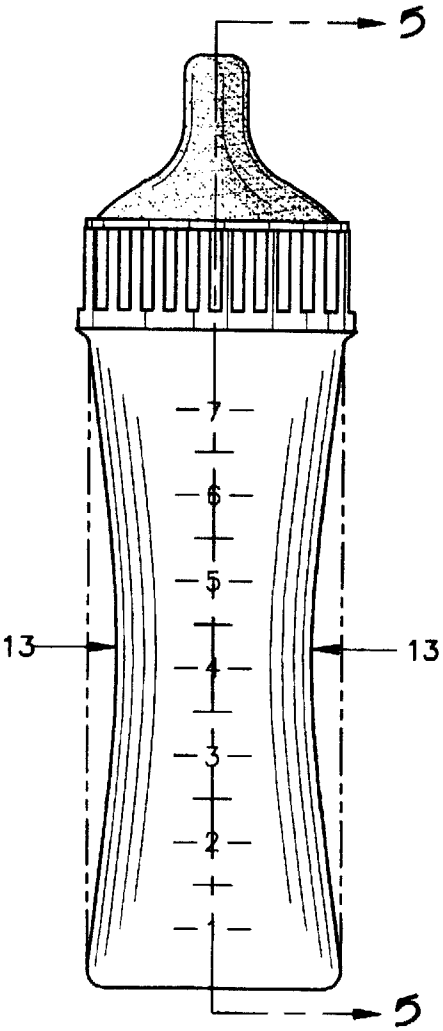
FIG. 4 depicts the assembled embodiment of FIG. 1 in a compressed state.

FIG. 3 depicts the embodiment of FIG. 1 with fluid 10 and air 11 held within the internal flexible bag 4. To eject air from the internal flexible bag 4, outer wall 24 of the central container are compressed inwardly, or radially as shown by arrows 13 of FIG. 4. Central container 3 is configured and formed from a material so as to be movable between a compressed state, shown in FIG. 4, wherein outer wall 24 is compressed radially inwardly, and a natural state, shown in FIG. 3, wherein outer wall 24 has reassumed its original configuration, also shown in FIG. 3, after compressing forces have been removed. As a result, the internal bags remain in a compressed state while the outer walls return to their natural state as depicted in FIG. 1. As depicted in FIG. 5, the resulting pressure on the internal bag forces the internal bag to compress and forces the air out 12 the nipple opening 9. As a result of the compression action all the air held within the internal flexible bag 4 is ejected, thereby as a result of the unidirectional nipple opening 9 leaving only fluid within the flexible bag 4. FIG. 5 further depicts the infant nursing device containing only fluid 10 within the internal flexible bag 4.

Figure 6:
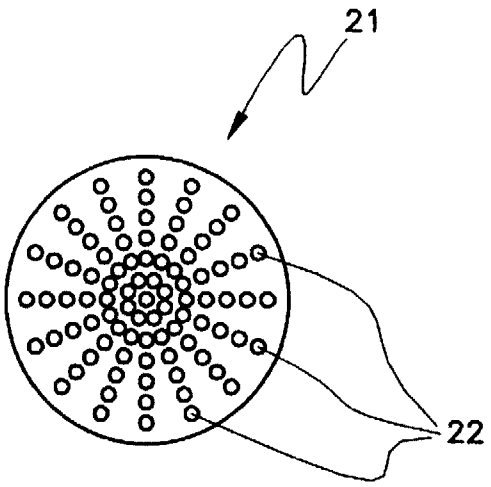
FIG. 6 depicts an alternate embodiment of the invention as viewed from below.

FIG. 6 depicts a bottom view of an alternate embodiment of the invention. As depicted, the invention includes a bottom 23. Bottom 23 includes a concentric arrangement of openings 22. Although depicted as a specific design, the bottom may comprise any combination and arrangement of openings and non-openings and may further be made of any material that will allow the bottom to flex with the side walls of the baby bottle.

It is to be understood that the provided illustrative examples are by no means exhaustive of the many possible uses of the invention. From the foregoing description, one skilled in the art can easily ascertain the essential characteristics of this invention and, without departing from the spirit and scope thereof, can make various changes and modifications of the invention to adapt it to various usages and conditions. For example, the artisan could construct the present invention in a square or other suitable shape. It is to be understood therefore that the present invention is not limited to the sole embodiment described above, but encompasses any and all embodiments within the scope of the following claims.

What is claimed is:

1. An improved infant nursing device, comprising:

a central container having a central cavity, a transparent circumferential wall surrounding said central cavity and having a bottom edge, and a screw top portion disposed at one end of said central container;

a top cap assembly having a nipple and an opening formed in said nipple, and threads for engaging said screw top portion of said circumferential wall; and a flexible bag disposed within said central cavity, said flexible bag having a lip for begin secured between said top cap assembly and said circumferential wall when said top cap assembly is threaded to said circumferential wall, said flexible bag thereby being open only to said nipple and to said opening formed in said nipple, said circumferential wall being radially inwardly compressible and movable between a compressed state and a natural state wherein said circumferential wall has returned to a configuration prevailing in the absence of compressing forces moving said circumferential wall to said compressed state, said circumferential wall having a lip located at said bottom edge, said lip turned inwardly to provide partial support for said bag.

2. The improved infant nursing device according to claim 1, said circumferential wall having a central opening defined by said lip, thereby exposing said flexible bag to the exterior of said circumferential wall.

3. The improved infant nursing device according to claim 1, said circumferential wall further comprising a bottom having a plurality of openings formed therein.

4. The improved infant nursing device according to claim 1, said circumferential wall and said flexible bag being transparent and having numerals disposed upon said circumferential wall, thereby designating content level existing within said improved infant nursing device.

5. An improved infant nursing device, comprising:

a central container having a central cavity, a transparent circumferential wall surrounding said central cavity and having a bottom edge, and a screw top portion disposed at one end of said central container;

a top cap assembly having a nipple and an opening formed in said nipple, and threads for engaging said screw top portion of said circumferential wall; and a flexible bag disposed within said central cavity, said flexible bag having a lip for being secured between said top cap assembly and said circumferential wall when said top cap assembly is threaded to said circumferential wall, said flexible bag thereby being open only to said nipple and to said opening formed in said nipple;

said circumferential wall configured to be radially inwardly compressible and movable between a compressed state and a natural state wherein said circumferential wall has returned to a configuration prevailing in the absence of compressing forces moving said circumferential wall to said compressed state, and having an underside having at least one opening, thereby exposing said flexible bag to the exterior of said circumferential wall, said circumferential wall and said flexible bag being transparent and having numerals disposed upon said circumferential wall, thereby designating content level existing within said improved infant nursing device, said circumferential wall having a lip located at said bottom edge, said lip turned inwardly to provide partial support for said bag.

* * * * *